US008167260B2

(12) United States Patent
Boccia et al.

(10) Patent No.: US 8,167,260 B2
(45) Date of Patent: May 1, 2012

(54) WINDOW AIR CONDITIONER ADJUSTABLE BRACE

(75) Inventors: Joseph Boccia, Garden City, NY (US); Frank Boccia, Searingtown, NY (US); Vincent Boccia, Plainview, NY (US)

(73) Assignee: Boccia Inc., Garden City Park, NY (US)

( * ) Notice: Subject to any disclaimer, the term of this patent is extended or adjusted under 35 U.S.C. 154(b) by 54 days.

(21) Appl. No.: 12/766,366

(22) Filed: Apr. 23, 2010

(65) Prior Publication Data

US 2010/0270448 A1 Oct. 28, 2010

Related U.S. Application Data

(60) Provisional application No. 61/172,029, filed on Apr. 23, 2009.

(51) Int. Cl.
*A47G 29/02* (2006.01)

(52) U.S. Cl. ..... 248/236; 248/209; 248/208; 248/241; 248/316.8

(58) Field of Classification Search ..... 248/678, 248/670, 208, 209, 236, 235, 241, 244, 316.8, 248/351, 674; 62/262; 454/204; 182/57, 182/62

See application file for complete search history.

(56) References Cited

U.S. PATENT DOCUMENTS

| | | | | | |
|---|---|---|---|---|---|
| 399,491 | A * | 3/1889 | Bukawietis | 182/62 |
| 896,150 | A * | 8/1908 | Plotke | 248/208 |
| 1,353,853 | A * | 9/1920 | Sandberg | 248/208 |
| 2,628,052 | A | 2/1953 | Cira | |
| 2,674,430 | A | 4/1954 | Galazzi et al. | |
| 2,717,139 | A * | 9/1955 | Jewell | 248/208 |
| 2,889,764 | A * | 6/1959 | McGrath et al. | 454/204 |
| 2,891,754 | A * | 6/1959 | Kuhlenschmidt et al. | 248/208 |
| 3,273,843 | A | 9/1966 | Bell, Jr. et al. | |
| 3,394,910 | A * | 7/1968 | Ulich | 248/208 |
| 5,027,614 | A | 7/1991 | Mori et al. | |
| 5,112,015 | A * | 5/1992 | Williams | 248/236 |
| 5,368,267 | A * | 11/1994 | Howard | 248/231.41 |
| 5,582,025 | A * | 12/1996 | Dubin et al. | 62/262 |
| 5,822,918 | A * | 10/1998 | Helfman et al. | 47/39 |
| 5,967,478 | A * | 10/1999 | Tynes | 248/241 |
| 6,907,749 | B2 * | 6/2005 | Geary | 62/259.1 |
| 7,121,105 | B1 * | 10/2006 | Rais | 62/262 |
| 7,191,990 | B2 * | 3/2007 | Hutter, III | 248/229.12 |
| 7,350,759 | B1 * | 4/2008 | Gray | 248/644 |
| 7,735,800 | B2 * | 6/2010 | Lunato et al. | 248/558 |

* cited by examiner

*Primary Examiner* — Nkeisha Smith
(74) *Attorney, Agent, or Firm* — Hoffman & Baron, LLP

(57) ABSTRACT

An adjustable brace for supporting a window air conditioner that includes: a pair of interior brackets on the inside adjustably attached to a pair of exterior brackets and a pair of locating brackets on the outside. The pair of interior brackets includes an interior leg extending downwardly from one end and adjustably secured to the wall by interior mounting plates. The pair of exterior brackets includes an exterior leg extending downwardly from one end and adjustably secured to the wall by exterior mounting plates. A cross member adjustably connects the two interior brackets to fit different size air conditioners. The adjustable brace extends through the window to adjustably support the window air conditioner.

20 Claims, 4 Drawing Sheets

30a,b
38
28a,b 14b
38
12b
32

14a
38
12a
31
32
31

38
26a,b 38
24a,b

WINDOW AIR CONDITIONER ADJUSTABLE BRACE

This application claims priority from provisional application Ser. No. 61/172,029, filed on Apr. 23, 2009, which is incorporated herein in its entirety.

BACKGROUND OF THE INVENTION

The present invention relates to a brace for an air conditioner and, more particularly, to an adjustable brace for support of a window air conditioner.

The prior art is replete with braces/supports for window air conditioners. However, each of these prior art devices has one or more significant disadvantages associated therewith. In this regard, those skilled in the art will appreciate that existing braces have been unable to address (in one device) all of the following requirements:

Non-Destructive Installation—a window air conditioner is generally considered a temporary installation in that it is typically removed from the window during the heating season, and is also generally removed by a homeowner when the property is sold. In this regard, the removal/installation of the window air conditioner is preferably accomplished without any damage to the existing structure (both interiorly and exteriorly). Often times, a lease agreement signed by a tenant will contain specific language to this point. Many prior art devices use hardware which penetrates the walls of the building, thereby leaving permanent damage to the structure when the window air conditioner and brace are removed.

Adjustability—because every window installation differs due to the specific type and size of the window, the material and design of the specific window frames and exterior/interior window sills, together with the differences in the air conditioner itself, a brace should be adjustable over a wide range of configurations. For example, older buildings may have wall thicknesses up to 3 feet, and include elaborate/intricate window sills and molding which can be damaged from the installation of a window air conditioner. Many prior art devices lack the range of adjustability required for these different wall thicknesses.

Ease of Installation—many prior art braces are complicated and/or difficult to install without special expertise and technical experience, and/or without specialized tools.

Interior installation—many prior art braces must be installed from the exterior of the building, thereby requiring ladders, scaffolds, or other such equipment. Of course, it will be recognized that an exterior installation increases both the difficulty and risks associated with the installation of such a brace, particularly for a high-rise structure. In addition, exterior-installed braces generally require permanent afixment to the structure, which obviously results in visible damage to the exterior of the building upon removal of the brace.

There is, therefore, a need in the art for a brace for a window-located air conditioner which can be installed/removed in a non-destructive manner, which provides the adjustability required for installations in a wide variety of window designs and in connection with a wide variety of air conditioners, which allows installation without the need for special expertise or technical experience, and which can be installed/removed from the interior of the building.

SUMMARY OF THE INVENTION

The adjustable brace for supporting a window air conditioner in a wall having an interior surface, an exterior surface and a window frame defining an opening therethrough is provided. The adjustable brace includes: a pair of interior brackets, a pair of exterior brackets, a pair of substantially flat locating brackets, a cross member, a pair of interior mounting plates and a pair of exterior mounting plates. The pair of interior brackets includes a substantially flat first member having a first end and a second end and an interior leg extending downwardly from the first end. The pair of exterior brackets includes a substantially flat second member having a first end and a second end and an exterior leg extending downwardly from the first end. The pair of substantially flat locating brackets has a first end and a second end and each is adjustably attached to and substantially parallel to one of the first members and one of the second members. The cross member adjustably connects the first members of the interior brackets. Each of the pair of interior mounting plates is adjustably attached to each of the interior legs of the interior brackets and is adapted to engage the interior surface of the wall. Similarly, each of the pair of exterior mounting plates is adjustably attached to each of the exterior legs of the exterior brackets and is adapted to engage the exterior surface of the wall. The adjustable brace is installed in the window and the first members, the second members and the locating brackets are adapted to adjustably support the window air conditioner.

The interior mounting plates and the exterior mounting plates can be secured to the interior legs and the exterior legs, respectively, by threaded rods. Preferably, each of the interior legs and exterior legs has a plurality of apertures for adjustably receiving the threaded rods. After the rods are inserted in the apertures, a plurality of fastening devices adjustably attach the threaded rods to the interior legs and/or exterior legs. These fastening devices are preferably wing nuts or other device that can secure the threaded rods to the legs.

Each of the first members, second members and locating brackets can have a plurality of apertures and a plurality of fastening devices can be used to adjustably attach the locating brackets to the first members and the second members. Each of the second ends of the locating brackets is a distal end with a flange that extends upwardly. The adjustable brace can also include a pair of support members that extend between one of the exterior legs and one of the locating brackets near its distal end.

The cross member can also be used as a retaining bracket that is adjustably attached to each of the first members of the pair of interior brackets and adapted to engage an interior portion of the window frame to secure the interior bracket to the window frame. The second ends of each of the first members of the interior brackets have a distal end, which extend from the interior leg through the window opening to the exterior. The second ends of each of the second members of the exterior brackets also have distal ends, which extend in the same direction as the distal ends of each of the first members. The locating brackets are attached to the interior and exterior brackets near their distal ends. After an air conditioner is positioned on the brace, an adjustable strap can be used to secure the air conditioner to the adjustable brace.

BRIEF DESCRIPTION OF THE DRAWINGS

The preferred embodiments of the window air conditioner adjustable brace of the present invention, as well as other objects, features and advantages of this invention, will be apparent from the accompanying drawings wherein.

DETAILED DESCRIPTION OF THE INVENTION

Figure 1:
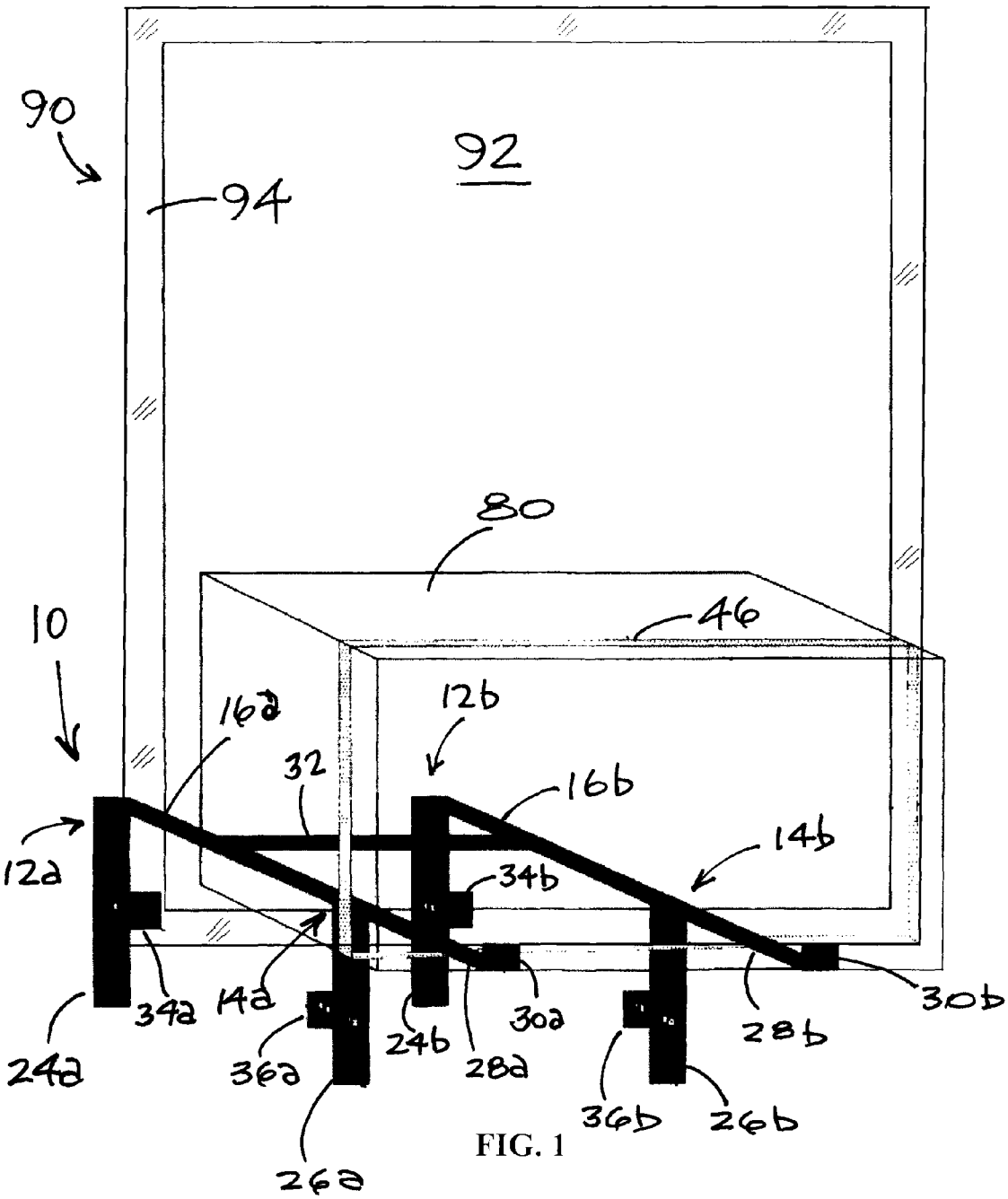
FIG. 1 is a perspective view showing the adjustable brace of the present invention supporting an air conditioner in a window.
Figure 2:
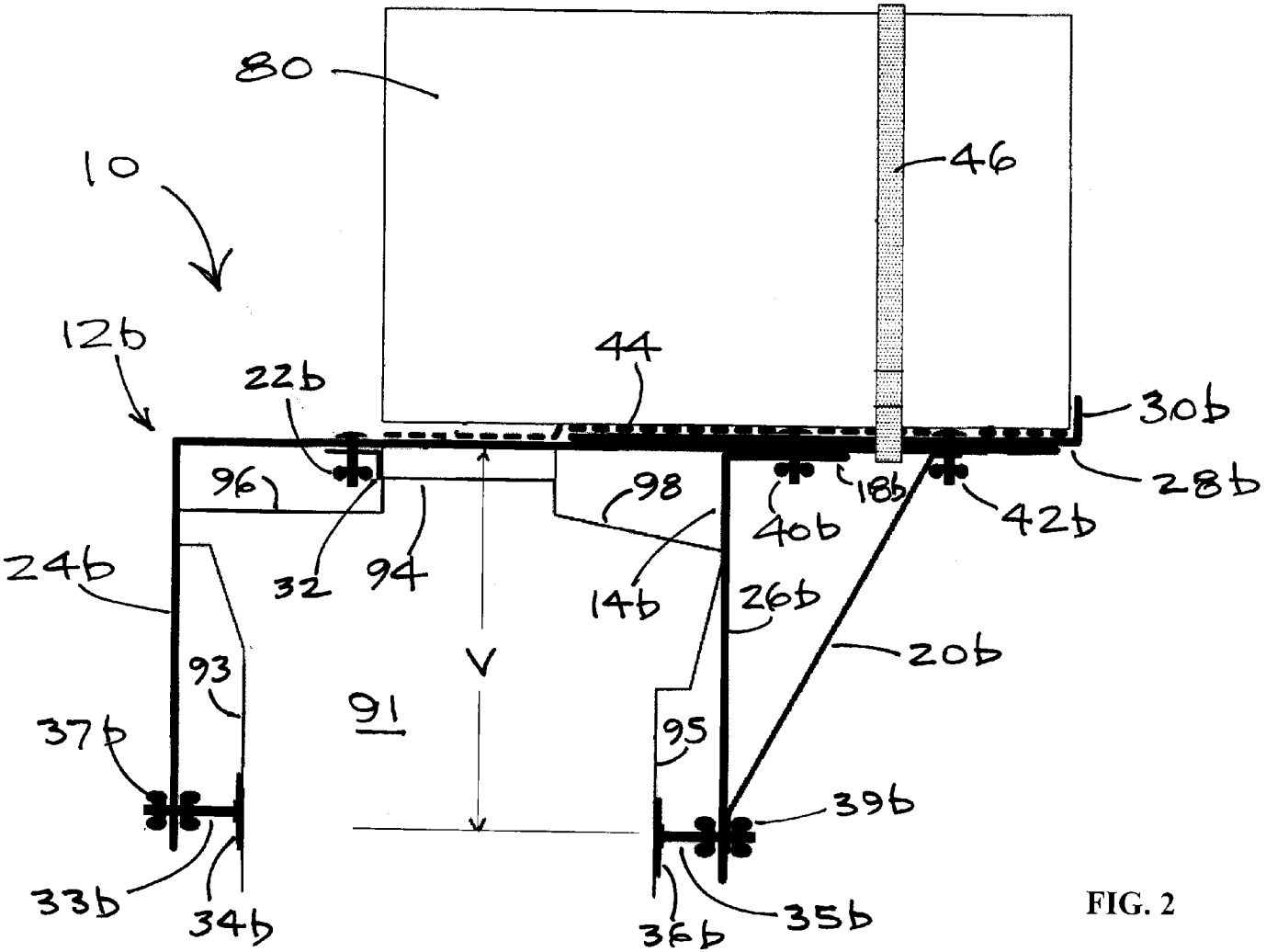
FIG. 2 is a side sectional view of the brace shown in FIG. 1 installed in a window opening.

An adjustable brace 10, formed in accordance with the present invention, is shown in FIGS. 1 and 2. The brace 10 is shown installed in a window 90 with an opening 92 and extends across the window frame 94, the interior window sill 96 and the exterior window sill 98. As shown, an air conditioner 80 may be supported upon brace 10, and secured thereto by, for example, a nylon strap 46. Of course, it is contemplated herein that air conditioner 80 may be secured to the brace in other manners, e.g., clips, brackets, etc.

Figure 8:
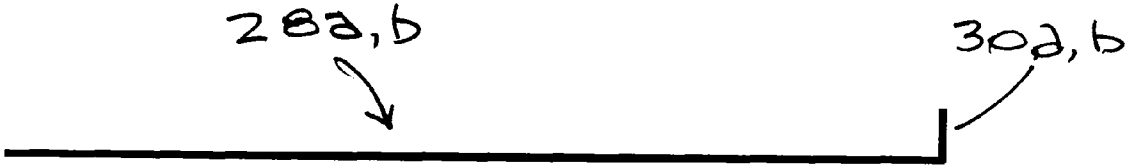
FIG. 8 is a side view of the locating bracket shown in FIG. 3.
Figure 10:
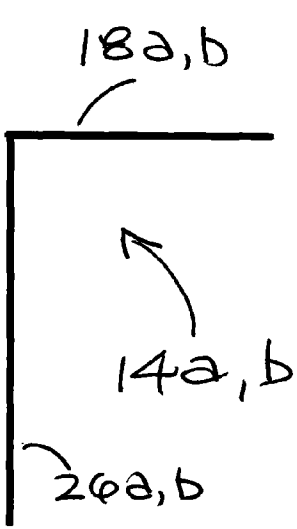
FIG. 10 is a side view of the exterior bracket of the brace of the present invention.
Figure 9:
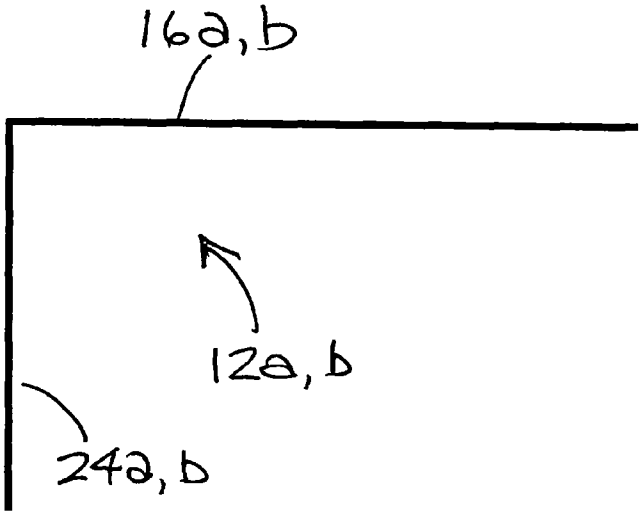
FIG. 9 is a side view of the interior bracket of the brace of the present invention.

The brace 10 includes a pair of interior brackets 12*a*, 12*b* (FIG. 9) and a pair of exterior brackets 14*a*, 14*b* (FIG. 10) that are disposed on opposing sides of the window 90. Each of the interior brackets 12*a*, 12*b* is formed by a substantially flat member 16*a*, 16*b* with an interior leg 24*a*, 24*b* (FIG. 6) extending from one end. Each of the exterior brackets 14*a*, 14*b* is formed by a substantially flat member 18*a*, 18*b* with an exterior leg extending 26*a*, 26*b* (FIG. 7) from one end. The brace 10 also includes a pair of locating brackets 28*a*, 28*b* (FIGS. 3 and 8), each of which is connected to one of the interior brackets 12*a*, 12*b* and one of the exterior brackets 14*a*, 14*b* on one end. On the opposing end, the locating brackets 28*a*, 28*b* have a flange 30*a*, 30*b*. As best seen in FIG. 2, flanges 30*a*, 30*b* provide a means of locating the air conditioner 80 on the brace 10, while also forming a physical stop, which prevents the air conditioner 80 from being pushed beyond the end of brace 10.

Figures 3, 4, 5, 6, 7:
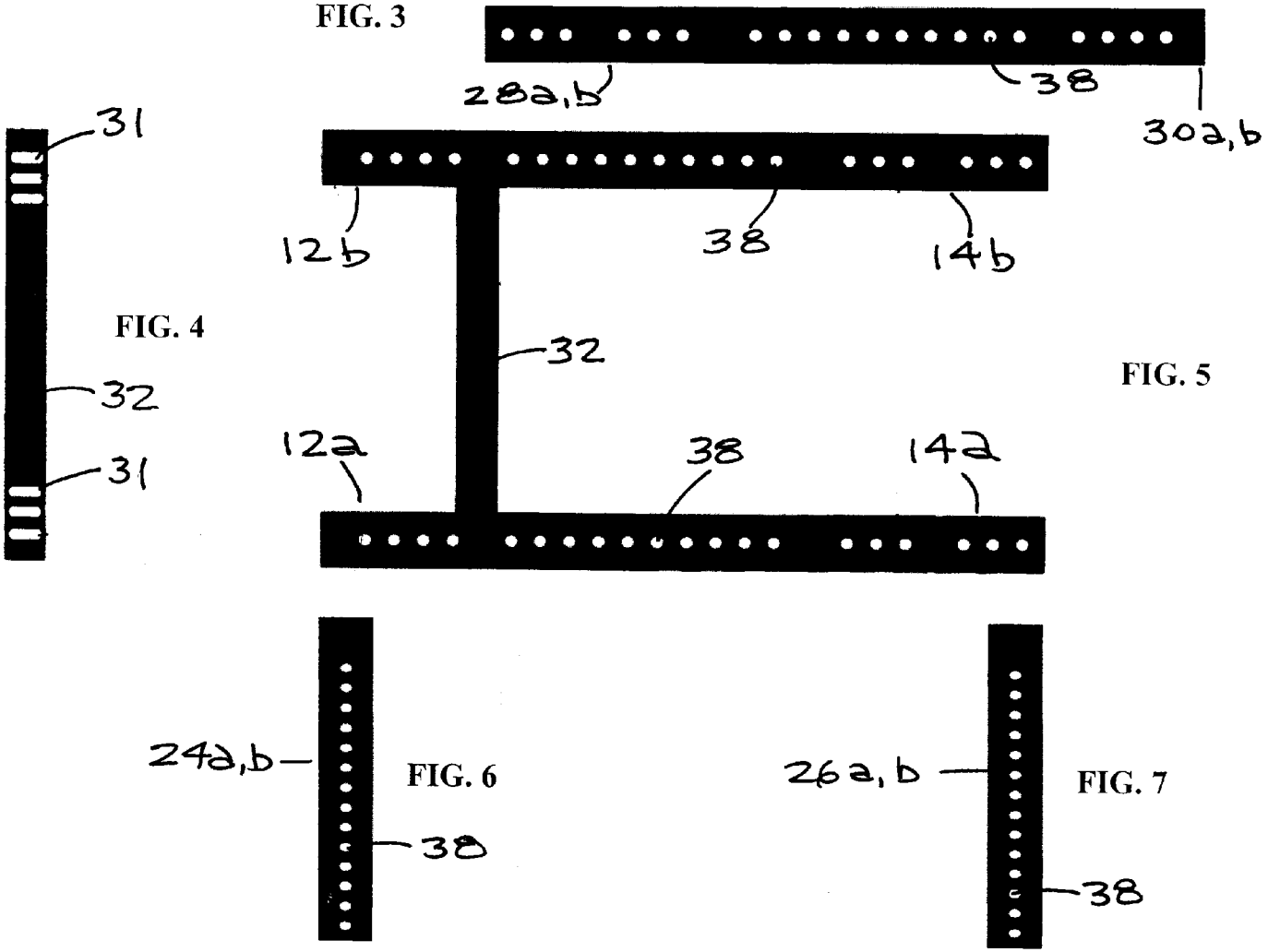
FIG. 3 is a plan view of the locating bracket of the brace of the present invention.
FIG. 4 is a plan view of the cross member of the brace of the present invention.
FIG. 5 is a plan view of the interior and exterior brackets of the brace of the present invention connected by the cross member.
FIG. 6 is a plan view of the interior leg of the brace of the present invention.
FIG. 7 is a plan view of the exterior leg of the brace of the present invention.

The brace 10 further includes a cross member 32 (FIG. 4) for spacing the interior brackets 12*a*, 12*b* at a pre-selected distance (see FIG. 5). It is contemplated that the brace 10 may be provided with multiple cross members of different lengths to provide the end user with flexibility in selecting the optimum spacing of the interior brackets 12*a*, 12*b* and exterior brackets 14*a*, 14*b* for different size air conditioners 80 and/or window openings 92. When the air conditioner 80 is installed, the end user selects the cross member 32 with the desired length before assembling the brace 10. Alternatively, cross member 32 may be formed as an adjustable member with a plurality of elongated apertures 31 to provide the desired adjustability.

The brace 10 further includes a set of interior mounting plates 34*a*, 34*b*, and a pair of exterior mounting plates 36*a*, 36*b*. Each mounting plate 34*a*, 34*b* and 36*a*, 36*b* is preferably rotatably attached to the end of a threaded rod 33*b* and 35*b*, which can be inserted through any one of a plurality of apertures 38 formed in the interior/exterior legs 24*a*, 24*b* and 26*a*, 26*b*. The threaded rods 33*b*, 35*b* are shown in FIG. 2 with respect to one side of the bracket 10. As used herein, the phrase "rotatably attached" means that the rods 33*b* and 35*b* are secured to the mounting plates 34*a*, 34*b* and 36*a*, 36*b* but can rotate freely without causing the mounting plates 34*a*, 34*b* and 36*a*, 36*b* to rotate (e.g., a ball and socket arrangement). In this manner, the mounting plates 34*a*, 34*b* and 36*a*, 36*b* can be located at a suitable vertical distance "V" from the top of the window frame 94 (to clear the window sills 96, 98 or other obstructions). Moreover, the threaded rods 33*b* and 35*b* attached to the interior/exterior legs 24*a*, 24*b* and 26*a*, 26*b* can be adjusted by fastening devices 37*b* and 39*b*, such as wing nuts or similar hardware, to compressively engage the mounting plate 34*a*, 34*b* and 36*a*, 36*b* with the opposing surfaces 93, 95 of the wall 91 (FIG. 2). This engagement is preferably limited to surface engagement, which does not require any physical penetration of the wall.

Figure 11:
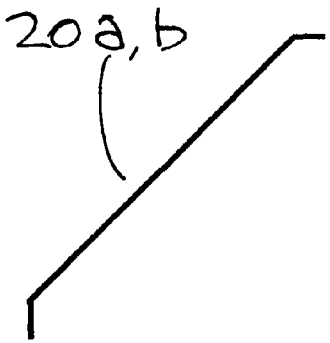
FIG. 11 is a side view of the support member of the brace of the present invention.

The brace 10 allows installation of a window-located air conditioner 80 without any permanent damage to the building structure, such as screw or bolt penetrations into the wall surfaces. More particularly, the brace 10 does not require mounting on the window sills 96, 98, which can be damaged by supporting the weight of a window air conditioner 80. As best seen in FIG. 2, the brace 10 can be adjusted to span both the interior and exterior window sills 16, 18. Those skilled in the art will appreciate that the weight of the air conditioner 80 will tend to cause the brace 10 to rotate in a clockwise direction, whereby a substantial portion of the load is preferably carried by the window frame 94 and the exterior wall of the building, rather than the window sills 96, 98. However, in some applications, the entire load can be carried by the brace 10 and the pair of interior brackets 12*a*, 12*b* does not contact the window frame 94. The brace 10 can also be provided with a pair of support members 20*a*, 20*b* (FIG. 11), which are attached to the locating brackets 28*a*, 28*b* and the exterior legs 26*a*, 26*b* as shown in FIG. 2.

As show in FIGS. 3-7, the interior and exterior brackets 12*a*, 12*b* and 14*a*, 14*b* and the locating brackets 28*a*, 28*b* can include a plurality of apertures 38. The locating brackets 28*a*, 28*b* can be secured to the interior and exterior brackets 12*a*, 12*b* and 14*a*, 14*b* by a plurality of fastening devices 40*a*, 40*b*, and can be secured to the interior bracket 12*a*, 12*b* at a second location by a second set of fastening devices 42*a*, 42*b*. The plurality of apertures 38 allows the locating brackets 28*a*, 28*b* to be adjustably positioned at a selected location so that the flanged ends 30*a*, 30*b* provide a positive stop for the rear end of the air conditioner 80, when the air conditioner 80 is properly positioned on the brace 10. Moreover, the plurality of apertures 38 on the horizontally-extending members 16*a*, 16*b* of the interior brackets 12*a*, 12*b* allow the interior brackets 12*a*, 12*b* to be adjustably attached to the horizontally-extending members 18*a*, 18*b* of the exterior brackets 14*a*, 14*b* to span both the interior and exterior window sills 96, 98. Finally, the plurality of apertures 38 along the horizontally-extending portion of the interior brackets 12*a*, 12*b* allows the cross member 32 extending between the two interior brackets 12*a*, 12*b* to be positioned at a pre-selected location, preferably close to the window frame 94. In a preferred embodiment, the cross member 22 is formed from a section of angled steel with one leg attached to the horizontally-extending members 16*a*, 16*b* of the interior brackets 12*a*, 12*b* and the other leg extending downwardly and engaging the window frame 94 as shown in FIG. 2 to provide extra support for the brace 10.

It will be appreciated by those skilled in the art that the brace 10 can be readily assembled without the need for any special expertise, technical experience or specialized tools (for example, the brace 10 can be assembled using an ordinary wrench and screwdriver), and installed from the interior side of the window opening 92. The fastening devices (e.g., wing nuts) 37*b* and 39*b* associated with the mounting plates 34*a*, 34*b* and 36*a*, 36*b* can generally be accessed and tightened from the interior side of the building. However, even in installations where the exterior mounting plates 34*a*, 34*b* and 36*a*, 36*b* may be difficult to reach due to a large exterior window sill 98, the design of the brace 10 still allows installation from the interior of a building. In such applications, the exterior mounting plates 36*a*, 36*b* can be pre-adjusted prior to connecting the exterior brackets 14*a*, 14*b* to the interior brackets 12*a*, 12*b*. The installer first attaches the interior brackets 12*a*, 12*b* to the locating brackets 28*a*, 28*b* with fasteners 42*a*, 42*b* and then to the cross member 32 with fasteners 22*a*, 22*b*. The locating brackets 28*a*, 28*b* end of the assembly is passed through the window 90 and the assembly is positioned on the bottom of the window frame 94. The pair of exterior brackets 14*a*, 14*b* are then positioned on the exterior side of the wall 91 and attached to the interior brackets 12a, 12b using fastening devices 40*a*, 40*b*. The brace 10 is then secured in place by tightening the fastening devices (wing nuts) 37*b* for the interior mounting plates 34*a*, 34*b*.

In one preferred embodiment, the components of the brace 10 are formed from sections of flat steel or other suitable materials having sufficient strength to support the weight of an air conditioner. Inasmuch as portions of brace 10 are exposed to the environment, brace 10 is preferably painted or treated with other rust-inhibiting coatings. A foam tape 44 may be secured to the upper surfaces of the interior brackets 12*a*, 12*b* and the locating brackets 28*a*, 28*b* to better seal the air conditioner 80 within the window opening 92, to reduce vibration of the air conditioner, and/or to prevent the air conditioner 80 from being scratched or damaged when it is positioned on the brace 10.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

We claim:

1. An adjustable brace for supporting a window air conditioner in a wall having an interior surface, an exterior surface and a window frame defining an opening therethrough, the adjustable brace comprising:

a pair of interior brackets, wherein each interior bracket comprises a substantially flat first member having a first end and a second end and an interior leg extending downwardly from the first end;

a pair of exterior brackets, wherein each exterior bracket comprises a substantially flat second member having a first end and a second end and an exterior leg extending downwardly from the first end;

a pair of substantially flat locating brackets, wherein each locating bracket has a first end and a second end and is adjustably attached to and substantially parallel to one of the first members and one of the second members;

a cross member adjustably connecting the first members of the interior brackets;

a pair of interior mounting plates adjustably attached to each of the interior legs of the pair of interior brackets and adapted to engage the interior surface of the wall; and a pair of exterior mounting plates adjustably attached to each of the exterior legs of the pair of exterior brackets and adapted to engage the exterior surface of the wall, wherein the first members, the second members and the locating brackets are adapted to adjustably support the window air conditioner.

2. The adjustable brace according to claim 1, wherein each of the interior mounting plates and each of the exterior mounting plates is secured to the interior legs and the exterior legs, respectively, by a threaded rod.

3. The adjustable brace according to claim 2, wherein each of the interior legs and each of the exterior legs has a plurality of apertures for adjustably receiving the threaded rods.

4. The adjustable brace according to claim 3, further comprising a plurality of fastening devices, wherein the fastening devices are adapted to adjustably attach the threaded rods to the interior legs and/or the exterior legs.

5. The adjustable brace according to claim 1, further comprising a plurality of fastening devices, wherein each of the first members, second members and locating brackets has a plurality of apertures and wherein the plurality of fastening devices are used to adjustably attach the locating brackets to the first members and the second members.

6. The adjustable brace according to claim 1, wherein the second end of each of the locating brackets is a distal end, and wherein the distal end has a flange that extends upwardly.

7. The adjustable brace according to claim 1, further comprising a retaining bracket, wherein the retaining bracket is adjustably attached to each of the first members of the pair of interior brackets and adapted to engage an interior portion of the window frame.

8. The adjustable brace according to claim 1, further comprising an adjustable strap that is adapted to secure the air conditioner to the adjustable brace.

9. The adjustable brace according to claim 1, wherein the second end of each of the first members has a distal end, and wherein the distal ends of the first members are adapted to extend from the interior leg through the window opening to the exterior, wherein the second end of each of the second members has a distal end, and wherein the distal ends are adapted to extend in the same direction as the distal ends of each of the first members.

10. The adjustable brace according to claim 1, further comprising a pair of support members, wherein each support member extends between one of the exterior legs and one of the locating brackets.

11. An adjustable brace for supporting a window air conditioner in a wall having an interior surface, an exterior surface and a window frame defining an opening therethrough, the adjustable brace comprising:

a pair of interior brackets, wherein each interior bracket comprises a substantially flat first member having a first end and a second end and an interior leg having a plurality of apertures and extending downwardly from the first end;

a pair of exterior brackets, wherein each exterior bracket comprises a substantially flat second member having a first end and a second end and an exterior leg having a plurality of apertures and extending downwardly from the first end;

a pair of substantially flat locating brackets, wherein each locating bracket has a first end and a second end and is adjustably attached to and substantially parallel to one of the first members and one of the second members;

a cross member adjustably connecting the first members of the interior brackets;

a pair of interior mounting plates, wherein each mounting plate is adjustably attached to one of the interior legs of the pair of interior brackets by a threaded rod, and wherein each mounting plate is adapted to engage the interior surface of the wall; and a pair of exterior mounting plates, wherein each mounting plate is adjustably attached to one of the exterior legs of the pair of exterior brackets by a threaded rod, and wherein each mounting plate is adapted to engage the exterior surface of the wall, wherein the adjustable brace extends through the window and wherein the first members, the second members and the locating brackets are adapted to adjustably support the window air conditioner, and wherein the plurality of apertures in the interior legs and the exterior legs adjustably receive the threaded rods.

12. The adjustable brace according to claim 11, further comprising a plurality of fastening devices, wherein the fastening devices are adapted to adjustably attach the threaded rods to the interior legs and/or the exterior legs.

13. The adjustable brace according to claim 11, further comprising a plurality of fastening devices, wherein each of the first members, second members and locating brackets has a plurality of apertures and wherein the plurality of fastening devices are used to adjustably attach the locating brackets to the first members and the second members.

14. The adjustable brace according to claim 11, wherein the second end of each of the locating brackets is a distal end and has a flange that extends upwardly.

15. The adjustable brace according to claim 11, further comprising a retaining bracket, wherein the retaining bracket is adjustably attached to each of the first members of the pair of interior brackets and adapted to engage an interior portion of the window frame.

16. The adjustable brace according to claim 11, further comprising an adjustable strap that is adapted to secure the air conditioner to the adjustable brace.

17. The adjustable brace according to claim 11, further comprising a pair of support members, wherein each support member extends between one of the exterior legs and one of the locating brackets.

18. An adjustable brace for supporting a window air conditioner in a wall having an interior surface, an exterior surface and a window frame defining an opening therethrough, the adjustable brace comprising:

a pair of interior brackets, wherein each interior bracket comprises a substantially flat first member having a plurality of apertures, a first end and a second end and an interior leg having a plurality of apertures and extending downwardly from the first end;

a pair of exterior brackets, wherein each exterior bracket comprises a substantially flat second member having a plurality of apertures, a first end and a second end and an exterior leg having a plurality of apertures and extending downwardly from the first end;

a pair of substantially flat locating brackets, wherein each locating bracket has a plurality of apertures, a first end and a second end and is adjustably attached to and substantially parallel to one of the first members and one of the second members, and wherein the second end of each of the locating brackets is a distal end and has a flange that extends upwardly;

a cross member adjustably connecting the substantially flat first members;

a pair of interior mounting plates, wherein each mounting plate is adjustably attached to one of the interior legs of the interior brackets by a threaded rod and one or more fastening devices, and wherein each mounting plate is adapted to engage the interior surface of the wall; and a pair of exterior mounting plates, wherein each mounting plate is adjustably attached to one of the exterior legs of the exterior brackets by a threaded rod and one or more fastening devices, and wherein each mounting plate is adapted to engage the exterior surface of the wall, wherein the first members, the second members and the locating brackets are adapted to adjustably support the window air conditioner, and wherein the plurality of apertures in the interior legs and the exterior legs adjustably receive the threaded rods.

19. The adjustable brace according to claim 18, further comprising a plurality of fastening devices, wherein the fastening devices are adapted to adjustably attach the flat locating brackets to the first members and the second members.

20. The adjustable brace according to claim 18, further comprising a retaining bracket, wherein the retaining bracket is adjustably attached to each of the first members of the interior brackets and adapted to engage an interior portion of the window frame.

* * * * *